United States Patent [19]

Smith

[11] 4,340,071

[45] Jul. 20, 1982

[54] CHANGE-A-BOWL PIPE

[76] Inventor: Robert L. Smith, Rte. 1, Box 412, Burgaw, N.C. 28425

[21] Appl. No.: 273,323

[22] Filed: Jun. 15, 1981

Related U.S. Application Data

[62] Division of Ser. No. 87,046, Oct. 22, 1979, Pat. No. 4,290,437.

[51] Int. Cl.[3] ..... A24F 7/04

[52] U.S. Cl. ..... 131/202; 131/212 A; 131/213; 131/218

[58] Field of Search ..... 131/202, 200, 201, 211, 131/212, 212 A, 216, 213, 339, 218, 227, 331, 338, 340

[56] References Cited

U.S. PATENT DOCUMENTS

| | | | |
|---|---|---|---|
| 1,849,640 | 3/1932 | Russo | 131/213 X |
| 2,146,256 | 2/1939 | Gobel | 131/218 |
| 2,654,370 | 10/1953 | Smith | 131/213 |
| 3,170,468 | 2/1965 | Smith | 131/213 |
| 3,780,745 | 12/1973 | Smith et al. | 131/212 A |
| 3,830,244 | 8/1974 | Luile | 131/340 |

*Primary Examiner*—Stephen C. Pellegrino
*Attorney, Agent, or Firm*—Shlesinger, Arkwright, Garvey & Dinsmore

[57] ABSTRACT

The present invention relates to a smoking pipe having a retroverted-flow filter around a bit member and having a bowl placed within a bowl receptacle for enabling quick and easy changing of the smoking bowl while additionally creating an air cooling space between the bowl and bowl receptacle. More specifically, the present invention represents an improvement on the bit member and bowl structure of U.S. Pat. No. 3,780,745.

8 Claims, 12 Drawing Figures

CHANGE-A-BOWL PIPE

This application is a division, of application Ser. No. 087,046, filed Oct. 22, 1979, now U.S. Pat. No. 4,290,437.

BACKGROUND OF THE INVENTION

Retroverted-flow filter pipe bits of the prior art as they relate to the present invention are best represented by U.S. Pat. Nos. 3,170,468 and 3,780,745. While these devices provide filtering abilities they are not as efficient as would be desired and improvements have been sought. In addition, the bowl structures of the prior art have generally consisted of a solid bowl formed integrally with or detachably connected to a stem or mouth piece. However, excessive heating of the external surface of the smoking bowl and a hot tasting smoke are often characteristic of the prior art smoking pipes. Attempts to overcome these difficulties have included U.S. Pat. Nos. 3,468,314 to Palmer, 3,292,639 to Zarikta, 2,534,476 to Plesh, 2,529,268 to Bowers, and 1,551,281 to Bauer. While these devices have been somewhat successful in reducing the heat of the smoking bowl surface, none of the prior art devices adequately accomplished the needed cooling of the smoking bowl.

OBJECTS AND SUMMARY OF THE INVENTION

It is therefore one object of the present invention to provide a smoking pipe with a bit member having a retroverted-flow filter around the bit member.

It is another object of the present invention to provide a smoking pipe with a retroverted-flow filter wherein the filter is opened at both of its ends and is a throw away filter which is inexpensive and easy to manufacture.

It is a further object of the present invention to provide a smoking pipe with a bit member having a plug stem integrally formed with the bit member for closing off one end of the retroverted-flow filter.

It is still another object of the present invention to provide a smoking pipe with a smoking bowl which is easily and quickly changeable within a bowl receptacle.

It is a still further object of the present invention to provide a smoking pipe with a bowl which is cooled by an air passage between the smoking bowl and bowl receptacle which air passage is fed with air by convection means through air holes in the bottom of the bowl receptacle.

It is another object of the present invention to provide a smoking pipe with a bowl receptacle having spacing means at the top inner surface to slightly space the top of the smoking bowl from the top of the bowl receptacle to further enhance the utility of the air passage between said bowl and said receptacle.

It is a further object of the present invention to provide a smoking pipe wherein the smoking bowl is inwardly and downwardly tapered and the bowl receptacle is not tapered and is substantially cylindrical so as to provide an efficient cooling air passageway.

It is a still further object of the present invention to provide a smoking pipe wherein the bowl receptacle has a flat horizontal bottom inner surface to securely fit against the bottom outside surface of the smoking bowl.

These and further objects of the present invention are accomplished by a smoking pipe having a retroverted-flow filter around a bit member and having a bowl placed within a bowl receptacle for enabling quick and easy changing of the smoking bowl while additionally creating an air cooling space between the bowl and bowl receptacle.

DETAILED DESCRIPTION OF THE INVENTION

Figure 1:
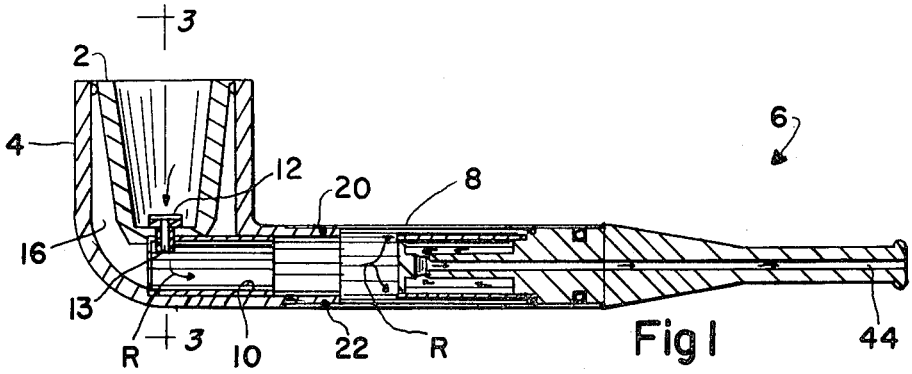
FIG. 1 is a cross sectional side elevational view showing the bit member, filter, bowl and pipe in assembled form.
Figure 2:
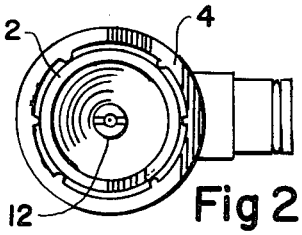
FIG. 2 is a top plan view of the bowl assembled within the bowl receptacle and secured by a screw member.
Figure 3:
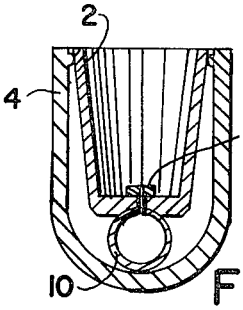
FIG. 3 is a cross sectional view of the bowl and bowl receptacle shown in FIG. 1 taken along lines 3—3 and viewed in the direction of the arrows.
Figure 4:
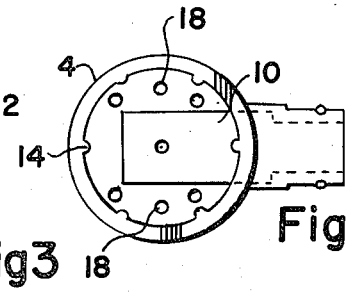
FIG. 4 is a top plan view of the bowl receptacle containing the hollow metal tube passageway and without the smoking bowl being contained within the bowl receptacle.

FIG. 1 shows a cut away view of the smoking pipe of the present invention including the bowl 2, bowl receptacle 4, bit 6 and stem 8 for connecting the bowl receptacle and bit member. Bowl 2 is detachably held within bowl receptacle 4 and attached to metal tube 10 by means of hollow screw 12. Bore hole 13 through the length of screw 12 serves as the passageway for smoke out of bowl 2 into metal tube 10 and rearwardly through stem 8 and bit 6. One important aspect of the smoking pipe of the present invention is that the screw secured bowl construction allows the user to easily and quickly change the bowl contained within bowl receptacle 4. As one bowl becomes old and is not providing a good flavored smoke due to tar build-up or other effects, the bowl 2 may be replaced by a new and better smoking bowl without the need to replace any of the remaining other pipe pieces. Another important aspect of the invention is the saddle-like shape of the bottom surface of bowl 2 (see FIG. 1) which provides for a more secure seating of bowl 2 onto metal tube 10. The saddle-like seating prevents sideways movement of bowl 2 and further seals the entrance of bore hole 13 into metal tube 10 to ensure that all smoke entering metal tube 10 proceeds through to stem 8 and bit 6.

Bowl 2 is constructed with a downward, inward taper while the receptacle 4 has a generally straight sided inner surface and is provided with protrusions 14 on the upper portion of its inner surface which position bowl 2 slightly away from bowl receptacle 4, and, together with the taper of the bowl, create air pockets 16 between the bowl and receptacle. Having an air passage around bowl 2 provides a cooler smoke because while tobacco is being burned within bowl 2, air is fed by convection through air holes 18, in the bottom of the receptacle, through air pocket 16 and exiting out the top of the bowl receptacle. This convection current will continuously feed air pockets 16 with fresher and cooler air which will absorb much of the heat from bowl 2 as the burning of tobacco continues.

Figure 5:
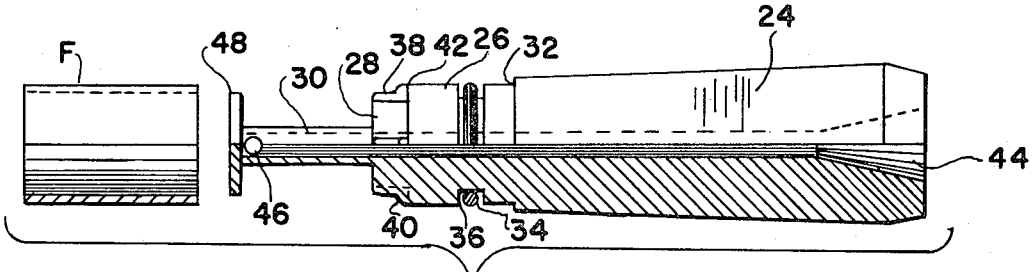
FIG. 5 is an exploded top plan view, a portion of which is in cross section of the bit member and filter.
Figure 6:
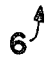
FIG. 6 is a top plan view of the bit member and filter in assembled form.
Figure 6:
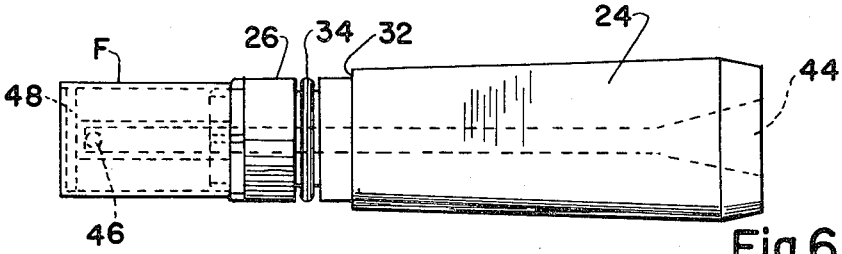

The stem-like portion 20 of bowl receptacle 4 is disposed within stem 8 and 0-ring 22 insures a firm air-tight fitting. Bit 6 is also disposed in stem 8 and (as best seen in FIGS. 5 and 6) is preferably of unitary construction including mouth piece 24, central portion 26 forward central portion 28 and shaft 30. Stem 8 fits around central portion 26, abuts shoulder 32 and is seated with O-ring 34 which is retained within recess 36. Filter F is a hollow tubular cardboard or the like filter open at both ends and is preferably of the Filtex TM type filter manufactured by the applicant. The Filtex TM filter F fits around shaft 30 and also fits within stem 8. Forward central portion 28 is generally tubular and contains a series of circumferentially placed ridges 36 which run longitudinally and are of a height to fit snuggly within the Filtex TM filter F. While fitting around ridges 38 and forward central portion 28, the Filtex TM filter F is prevented from sliding over central portion 26 by shoulder 40 against which the Filtex TM filter F will abut creating a gap between the filter and flange 42. Futhermore, when the Filtex TM filter F abuts shoulder 40 the flat circular end or plate-like head 48 of shaft 30 is positioned just rearward the front end of filter F and plugs that end of the filter closed. This construction of the filter and bit is an important improvement over the prior art where filters were manufactured with one closed end. The double open ended construction of the Filtex TM filter F of the present invention however reduces manufacturing costs and, in addition, removes the possibility of the Filtex TM filter F obstructing smooth passage into the bit member 6. With the prior art closed ended filters, smoke entered the forwardmost end of the bit member 6 which was disposed within the Filtex TM filter F and near the closed end of the cardboard Filtex TM filter F. This type of bit member 6 was susceptible to being closed off to smoke entry by the cardboard filter; however, the present invention provides a hole 46 within the side of shaft 30 thereby being removed from the possibility of being closed off to the passage of smoke.

The smoke circulation of the pipe of the present invention, as shown by arrows R in FIG. 1, begins as the smoke passes through bore hole 13 in screw 12 into and through metal tube 10 and stem 8. When it approaches the bit, the smoke continues between the Filtex TM filter F and stem 8, curls around the rearward end 44 of the filter F, follows forwardly along the inner surface of the Filtex TM filter F, enters the smoke duct 44 by means of hole 46 in shaft 30 and finally exits at the mouth piece 24. The smoke circulation pattern further enhances the cool smoke as provided by the smoking pipe of the present invention.

Figure 7:
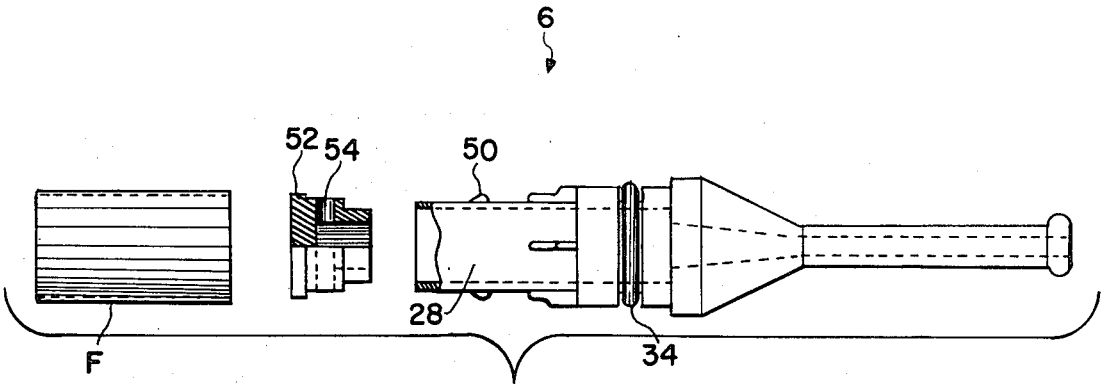
FIG. 7 is a partially broken away exploded side elevational view of a modified form of the bit member and filter with a portion of the bit member broken away to show cross sectional details.
Figure 8:
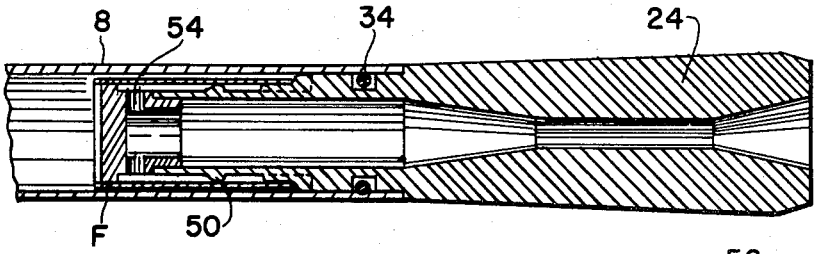
FIG. 8 is a cross sectional side elevational view of a modified form of the bit member, filter and stem in assembled form a portion of which is broken away.

FIGS. 7 and 8 show a modified form of the bit 6 wherein shaft 30 is replaced by an extended forward central portion 28 having tapered projections 50, plug end 52, and smoke entry hole 54. Tapered projections 50 run longitudinal on portion 28, are circumferentially placed, and gradually taper toward the mouth piece 24. This modified form of the bit member 6 is most preferably used with slightly longer filters as the tapered projections 50 will aid in the proper placement and fit of larger filters.

Figure 10:
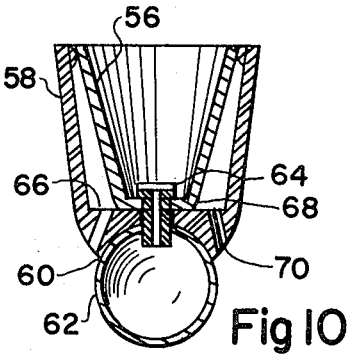
FIG. 10 is a cross sectional view of the bowl and bowl receptacle shown in FIG. 8 taken along lines 10—10 and viewed in the direction of the arrows.
Figure 9:
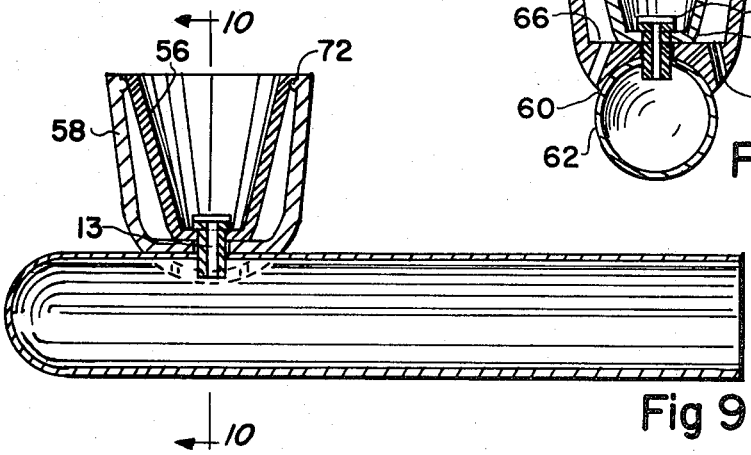
FIG. 9 is a cross sectional side elevational view of a modified form of the smoking pipe of the present invention.

Another modified form of the present invention is shown in FIGS. 9 and 10. This form of the invention provides a pipe with a changeable pipe bowl 56 and bowl receptacle 58. As best shown in FIG. 8, the outside surface of receptacle 58 is formed with channel 60 for fitting about the pipe stem 62 and secured in place by screw 64. While channel 60 is provided on the outside of receptacle 58, the inside bottom surface 66 of receptacle 58 is flat and horizontal in order to provide a proper surface for a secure fit against the flat bottom 68 of bowl 56. This form of the pipe of the present invention is also provided with air holes 70 and may be provided with projections 72 for again providing cooling to the pipe 56 by air passage induced by convection means.

Figure 11:
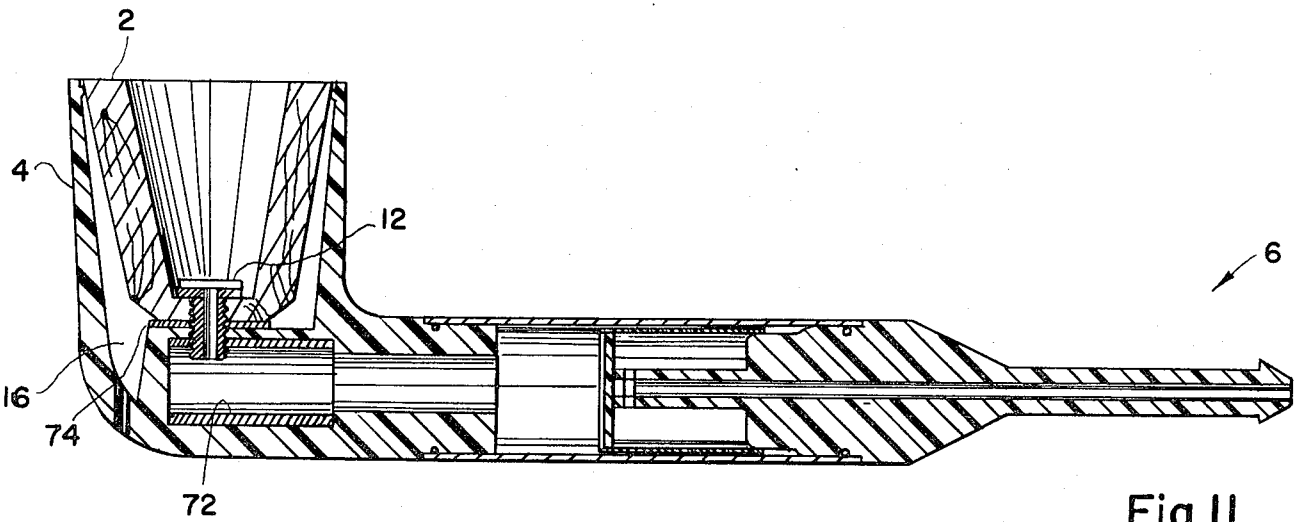
FIG. 11 is a cross sectional side elevational view of a modified form of the invention showing the bit member, filter, bowl and pipe in assembled form.
Figure 12:
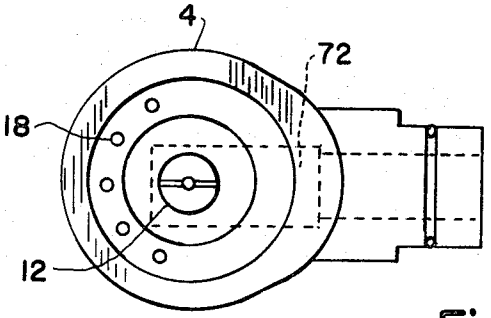
FIG. 12 is a top plan view of the bowl receptacle without the smoking bowl being contained within the bowl receptacle.

FIGS. 11 and 12 show a third modified form of the invention wherein cylindrical tube 72 is molded into bowl receptacle 4. In the above described embodiment (see FIG. 1) metal tube 10 is contained within bowl receptacle 4 but is not molded as an integral part of the bowl receptacle. In the alternative form shown in FIG. 11, cylindrical tube 72 is permanently secured within bowl receptacle 4 below the flat floor portion 74 by being formed within the plastic molded material of the bowl receptacle. This modified form of the smoking pipe results in a more simple and therefore less costly production because only one step is required to prepare the smoking bowl 4 and simultaneously secure cylindrical tubes 72 therein. Tube 72 is preferably comprised of aluminum but may be of other suitable materials.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A smoking pipe comprising:

(a) a bowl;

(b) a bit member;

(c) a tubular stem member for attaching said bit to said bowl and having forward and rearward ends and a main body portion;

(d) a generally cylindrical removable retroverted-flow filter being positioned over said bit and within said stem;

(e) said bit member having a rearwardly projecting mouthpiece first portion; a generally tubular second portion projecting forward of said first portion and fitting telescopically within said stem, a bit third portion being coaxial with and extending forward from said second portion so as to form an annular shoulder, and a plug shaft cooperating with and extending forward of said third portion and having a forward end;

(f) means associated with said third portion for spacing said filter forwardly from said shoulder;

(g) said third portion and said plug shaft fitting telescopically within said filter;

(h) said filter being open at both ends and including a forwardmost end;

(i) the forward end of said plug shaft being a circular plate-like head wherein said plate-like head is in diameter essentially equal to the inside diameter of said filter and said plate-like head is essentially at said forwardmost end of said filter;

(j) a smoke duct through said bit and ending short of said plate-like head; and (k) an outlet opening in said plug shaft cooperating with said smoke duct and being generally rearward of said plate-like head.

2. A smoking pipe as in claim 1 and wherein:

(a) said plate-like head and said plug shaft are removable from said bit member.

3. A smoking pipe as in claim 1 and wherein:

(a) said plate-like head and said plug shaft are integral with said bit member.

4. A smoking pipe as in claim 1 and wherein:

(a) said means associated with said third portion for spacing said filter forwardly from said shoulder including a series of circumferentially placed ridges on said third portion running longitudinally thereon; and (b) said ridges being of a height so as to fit snuggly with said filter.

5. A smoking pipe as in claim 1 and wherein:

(a) said bowl including a stem-like portion;

(b) said stem-like portion being disposed within said forward end of said tubular stem and including (c) an O-ring between said stem-like portion and said forward end of said tubular stem for providing an air tight seal.

6. A smoking pipe as in claim 1 and wherein:

(a) said second portion forming an annular shoulder with said mouthpiece first portion;

(b) said second portion having an annular recess;

(c) an O-ring being within said annular recess;

(d) said tubular stem member encompassing said filter and said second portion and abutting against said annular shoulder formed between said second portion and said mouthpiece; and (e) said tubular stem portion maintained in abutting relationship with said annular shoulder by frictional contact with said O-ring within said annular recess.

7. A smoking pipe as in claim 1 and wherein:

(a) said plug shaft having a rearwardly extending portion telescopically fitting within said third portion; a main body portion having outside diameter substantially equal to the outside diameter of said third portion; and a forwardly positioned annular flanged portion;

(b) said forwardly positioned annular flanged portion having outside diameter essentially equal to the inside diameter of said filter; and (c) said forwardly positioned annular flanged portion positioned essentially at the forwardmost end of said filter.

8. A smoking pipe as in claim 7 and wherein:

(a) said bit having a smoke duct running therethrough and ending short of said annular flanged portion; and (b) said main body portion of said plug shaft having an inlet opening therein, cooperating with said smoke duct and being generally rearward of said forward annular flanged portion.

* * * * *